United States Patent [19]

Nukushina et al.

[11] Patent Number: 4,669,861

[45] Date of Patent: Jun. 2, 1987

[54] ELECTROPHOTOGRAPHIC RECORDING APPARATUS

[75] Inventors: Etsuzi Nukushina, Nara; Takao Tagawa, Kashihara; Yoshiyuki Nakai, Yamatokoriyama, all of Japan

[73] Assignee: Sharp Kabushiki Kaisha, Osaka, Japan

[21] Appl. No.: 748,802

[22] Filed: Jun. 26, 1985

[30] Foreign Application Priority Data

Jun. 29, 1984 [JP] Japan ..... 59-136108
Aug. 31, 1984 [JP] Japan ..... 59-183309

[51] Int. Cl.[4] ..... G03G 15/16
[52] U.S. Cl. ..... 355/14 TR; 355/3 TR
[58] Field of Search ..... 355/3 TR, 3 R, 3 CH, 355/14 TR; 430/48, 126

[56] References Cited

U.S. PATENT DOCUMENTS 4,171,157 10/1979 Suzuki ..... 355/3 TR
4,341,457 7/1982 Nakahata et al. ..... 355/3 TR

*Primary Examiner*—R. L. Moses
*Attorney, Agent, or Firm*—Armstrong, Nikaido, Marmelstein & Kubovcik

[57] ABSTRACT

An electrophotographic recording apparatus which repeats the development of an electrostatic latent image corresponding to the original, which is formed once on an image supporting means, with a toner and the succeeding transfer of the resulting toner image to a transfer substance, thereby producing a number of copies of the original, wherein said recording apparatus comprises a transferring means having at least one corona charger connected to a high AC voltage source to repeatedly conduct transfer and discharge, regions in which said transfer and said discharge are carried out, respectively, being adjacent to each other.

10 Claims, 11 Drawing Figures

ELECTROPHOTOGRAPHIC RECORDING APPARATUS

BACKGROUND OF THE INVENTION

1. Field of the Invention

This invention relates to a retention-type electrophotographic recording apparatus producing a number of copies of the original from an electrostatic latent image, which is formed once on a photoreceptor, by repetition of the development of the latent image with a toner and transfer of the toner image to a transfer paper.

2. Description of the Prior Art

As an electrophotographic method for the production of two or more copies from an electrostatic latent image which is formed once on a photoreceptor, a roller-transfer method for conducting transfer of the toner image to a transfer paper using rollers and an ionic beam modulation method using a screen photoreceptor have been proposed.

According to the roller-transfer method, the transfer paper is pressed against the toner image on the photoreceptor by a conductive gum roller or a roller having an dielectric layer on the surface thereof, to which a high pressure is applied. The roller mainly serves to prevent electrical destruction and/or contamination of the latent image on the photoreceptor.

On the other hand, according to the ionic beam-modulation method, an ionic beam is modulated based on a first latent image on a screen photoreceptor having a slit to form a second latent image, which is then developed with a toner. The latent image is retained for successive development and transfer to obtain the necessary number of copies.

Both of the above-mentioned conventional transfer methods can provide a plurality of copies by the repeated use of an latent image formed once on a photoreceptor until the potential of the latent image decays to a certain level.

However, in the roller transfer method, the adhesion of toner to the surface of the roller occurs resulting in non-uniformity of solid areas and/or the formation of white spots in solid areas. The roller must uniformly press the transfer paper to the photoreceptor and is sometimes directly brought into contact with the photoreceptor causing damage to the photoreceptor. In order to eliminate damage to the photoreceptor, resulting in unacceptable and/or indistinct images, the apparatus required for the roller transfer method must have a complicated structure.

Similarly, the ionic beam modulation method requires not only a large scale-apparatus but also troublesome processes. The production of the apparatus required for the ionic beam modulation method is quite difficult and is expensive.

To eliminate the above-mentioned drawbacks, a corona transfer method using a DC corona charger can be employed, wherein the back face of the transfer paper which has been in contact with a toner image on a photoreceptor is corona-charged with charges having a different polarity from the charging polarity of the toner and, due to the resulting electric field therebetween, the toner image is transferred to the transfer paper. The electric charges injected into the transfer paper in the transfer step of the toner image to the transfer paper create a potential in the region of the latent image corresponding to the background in the original, causing the increase in a fog density from the second copy. The electric charges also bring about the adhesion of the transfer paper to the photoreceptor to cause a decrease in capacitance of the transfer paper against the ground and the steep rise of the transfer paper potential in the succeeding separation step of the transfer paper, resulting in an electric discharge therebetween so that the latent image on the photoreceptor is electrically contaminated and provides unacceptable copies. Although the rise of the potential in the region of the latent image corresponding to the background in the original can be avoided by the transfer of electric charges to the photoreceptor in the transfer step at a decreased transfer output power, the electrical contamination of the latent image due to electrical discharge is not eliminated as the transfer paper is insufficiently adhered to the photoreceptor to result in an insufficient transfer of the toner image thereto.

To improve such an insufficient transfer of the toner image to the transfer paper, the back face of the transfer paper can be subjected to a discharge treatment just after the transfer of the toner image in order to decrease the transfer paper potential. However, the transfer region must be close to the discharge region and the DC output in the transfer region must be reduced, so that a stable transfer of the toner image to the transfer paper cannot be carried out.

SUMMARY OF THE INVENTION

The electrophotographic recording apparatus of this invention which overcomes the above-discussed disadvantages and other numerous drawbacks and deficiencies of the prior art, repeats the development of the electrostatic latent image corresponding to the original, which is formed once on an image supporting means, with a toner and the succeeding transfer of the resulting toner image to a transfer substance, thereby producing a number of copies of the original, wherein said recording apparatus comprises a transferring means having at least one corona charger connected to a high AC voltage source to repeatedly conduct transfer and discharge, regions in which said transfer and said discharge are carried out, respectively, being adjacent to each other.

The AC corona generated in said transfer region contains, in a preferred embodiment, an element having a different polarity from the charging polarity of said toner to a greater extent than the same polarity as that of said toner, and acts on the back face of said transfer substance.

The corona chargers are, in a preferred embodiment, disposed in the transfer region and the discharge region, respectively.

In an alternative embodiment, the corona chargers are disposed in the transfer region and the discharge region, respectively, and a regulation means for transfer is disposed in the transfer region.

In another alternative embodiment, the corona chargers are disposed in the transfer region and the discharge region, respectively, and at least two regulation means, one of which is used for transfer and the other of which is used for discharge, are disposed in the transfer region.

The transferring means comprises, in a preferred embodiment, at least one corona charger connected to at least one high AC voltage source, and at least two regulation means, one of which is used for transfer and the other of which is used for discharge, the regulation means being controlled independently.

For transfer of the toner image to the transfer substance, a high AC voltage having a different polarity from the charging polarity of the toner and being unsymmetrical with respect to zero voltage thereof is, in a preferred embodiment, applied to the corona charger.

The regulation means comprises, in a preferred embodiment, a regulation grid.

The regulation means further comprises, in a preferred embodiment, a selection circuit for selecting a grounding mode of said regulation grid to control the transfer efficiency of the transferring means.

The regulation grid is, in a preferred embodiment, grounded through a resistor or a diode selected by said selection circuit depending upon external signals with regard to the quantity of copies, the decrease in the surface potential of the transfer substance, etc.

Thus, the invention described herein makes possible the objects of (1) providing an electrophotographic recording apparatus, using corona chargers, which transfers a toner image to a transfer paper in the transfer region of the transferring means and subsequently suppresses a rise of the potential of the transfer paper in an electrical discharge region which is adjacent to the transfer region, thereby preventing electrical destruction and/or contamination of the electrostatic latent image from the second copying cycle and producing a number of excellent quality copies of the original from the electrostatic latent image formed once on a photoreceptor; and (2) providing an electrophotographic recording apparatus which can control transfer efficiency depending upon the quantity of copies, the decrease in the surface potential of the transfer paper, etc., to thereby maintain the density of image to be transferred to the transfer paper at a given level, resulting in excellent quality copies of the original.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
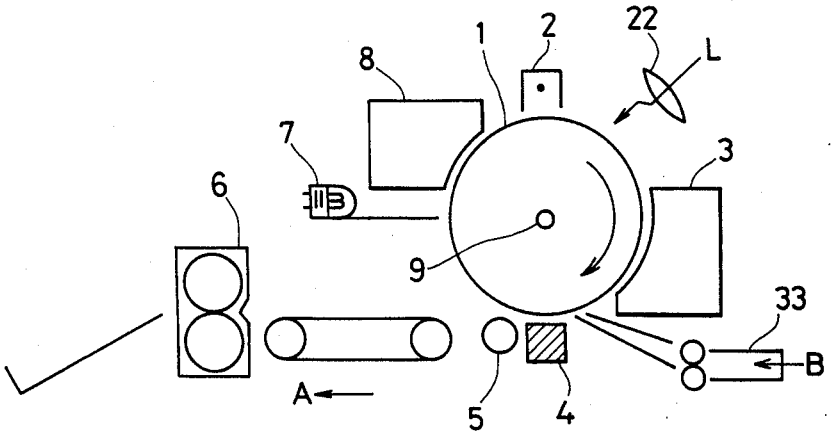
FIG. 1 is a schematic illustration of an apparatus of this invention.

FIG. 1 shows an electrophotographic recording apparatus of this invention which comprises an image supporting means such as a photoreceptor drum 1 rotatably supported by a shaft 9, a corona charger 2 disposed near the drum 1, an exposure means 22 near the drum 1 downstream of the charger 2, a developing means 3 near the drum 1 downstream of the exposure means 22, a transferring means 4 near the drum 1 downstream of the developing means 3, a discharging means 7 near the drum 1 downstream of the transferring means 4, and a cleaning means 8 near the drum 1 downstream of the discharging means 7.

The recording apparatus operates as follows:

The photoreceptor drum 1 is uniformly charged by the corona charger 2 and then subjected to an exposure treatment with a light (or a laser light modulated by a recording signal, etc.) using the exposure means 22 to form an electrostatic latent image thereon corresponding to the original L. The electrostatic latent image is then developed with color toner particles by the developing means 3 to thereby form a toner image on the photoreceptor drum 1. As the photoreceptor drum 1 turns around the shaft 9, the toner image comes into contact with a transfer substance such as a transfer paper (not shown) from a paper feeding cassette 33 while the transfer paper is carried in the direction of arrowed marks from B to A through a region between the photoreceptor drum 1 and the transferring means 4.

By the transferring means 4 which is described below in detail, the transfer paper is effectively corona-charged with electric charges having a different polarity from the charging polarity of the toner, to thereby transfer the toner image thereto, and then conveyed to a fixing means 6 through a separating means 5, resulting in the first copy of the original. The photoreceptor drum 1 which retains the electrostatic latent image thereon continues to turn around the shaft 9, and repeats the development of the latent image with the color toner and the subsequent transfer of the resulting toner image to the transfer paper to produce the necessary quantity of copies while the discharging means 7, the cleaning means 8, the charging means 2 and the exposure means 22 are not working.

Figure 2:
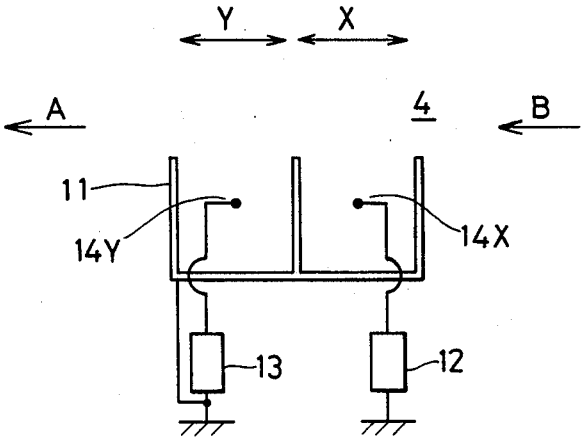
FIG. 2 is an enlarged illustration of a transferring means in the apparatus in FIG. 1.

FIG. 2 shows an example of the transferring means 4 comprising a sealed case 11 made of a metal such as stainless steel, aluminum, etc., which contains two sections one of which is a transfer region X and the other of which is an electric discharge region Y; and wire electrodes 14X and 14Y made of tungsten, etc., which are laid within the transfer region X and the electric discharge region Y, respectively. The wire electrodes 14X and 14Y are connected to high AC voltage sources 12 and 13, respectively.

Figure 3:
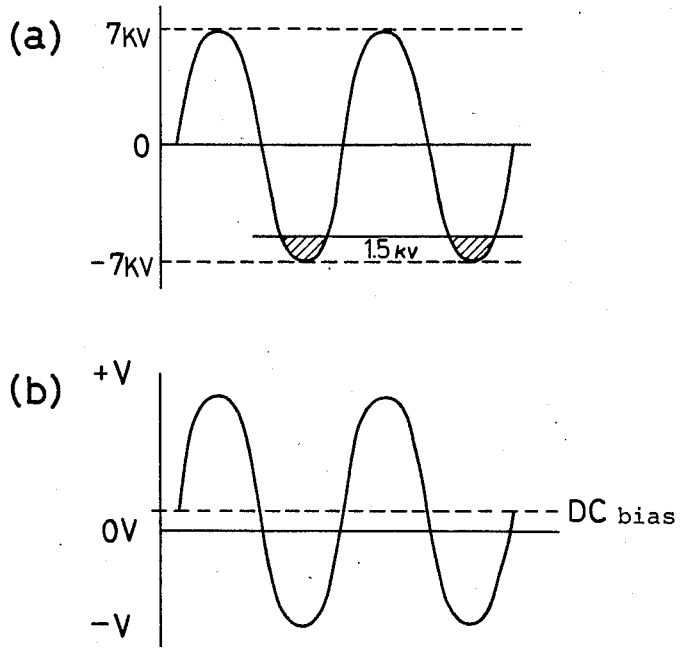
FIGS. 3(*a*) and (*b*), respectively, are graphs showing waves of an AC voltage applied to the transferring means.

An AC voltage from the AC voltage source 12 is applied to the wire electrode 14X within the transfer region X in the transferring means 4 in a wave shape which is unevenly distributed toward a different polarity from the charging polarity of the toner with respect to zero voltage. For example, an AC voltage having a frequency of 300 Hz and the peak voltage of $\pm 7$ KV is emitted from the AC voltage source 12 in a manner that, as shown in FIG. 3(*a*), the area in the range of from the peak voltage to approximately 2 KV in the direction of the same polarity as the toner (e.g., the area at a distance of 1.5 KV from the negative peak voltage of $-7$ KV) is clipped. Alternative uneven distribution of the voltage wave can be attained by the application of a positive bias voltage to the wire electrode 14X. The extent of uneven distribution of the voltage wave depends upon the transfer mode.

Since the transferring means 4 has the above-mentioned structure, corona ions which are charged with a different polarity from the charging polarity of the toner act on the back face of the transfer paper in the transfer region X to bring about an effective transfer of the toner image to the transfer paper. Moreover, other corona ions which are charged with the same polarity as the toner prevent an excessive increase in the back face potential of the transfer paper, thereby attaining a sufficient transfer efficiency. The back face of the transfer paper is subsequently electrically discharged by an AC charging treatment in the electric discharge region Y, so that a steep rise of the potential of the transfer paper in the succeeding separation step can be prevented. Thus, the electrostatic latent image can be retained on the photoreceptor even on and after the second copying cycle without undergoing electrical destruction and/or contamination, and forms an excellent and distinct image on the transfer paper.

Figure 4:
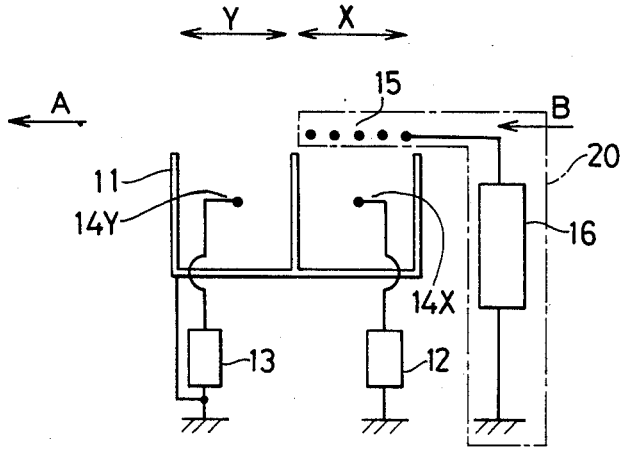
FIGS. 4 to 7 are other transferring means, respectively, of this invention.

FIG. 4 shows another transferring means 4 which further comprises a regulation means 20 in the transfer region X. The regulation means 20 comprises a regulation grid 15 and a regulation device 16 such as a diode for grounding the grid 15 therethrough. The voltage to be applied to the wire electrode 14X has the same wave as shown in FIG. 3(*a*) or 3(*b*). Depending upon the degree of uneven distribution of the AC voltage from the AC voltage source 12, a certain amount of voltage is applied to the regulation grid 15 so that positive or negative corona ions required for the transfer of the toner image to the transfer paper can reach the back face of the transfer paper. According to the transferring means 4 of the above-mentioned structure, corona ions having a different polarity from the charging polarity of the toner act on the back face of the transfer paper, resulting in an electric field required for the toner transfer between the transfer paper and the photoreceptor. Moreover, a minimum amount of corona ions having the same polarity as the toner, which are required to suppress an excessive rise of the potential of the transfer paper, can be produced to act on the back face of the transfer paper.

Figure 5:
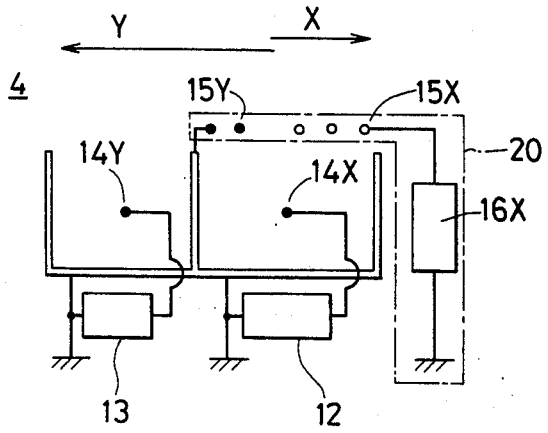

FIG. 5 shows another transferring means 4 which further comprises a transfer regulation grid 15X and a discharge regulation grid 15Y in the transfer region X, thereby substantially enlarging the discharge region Y over the transfer region X. Thus, wherever the transfer paper is separated from the photoreceptor after transfer, a steep rise of the potential of the transfer paper can be suppressed so that electrical destruction and/or contamination of the electrostatic latent image on the photoreceptor can be effectively avoided.

Figure 6:
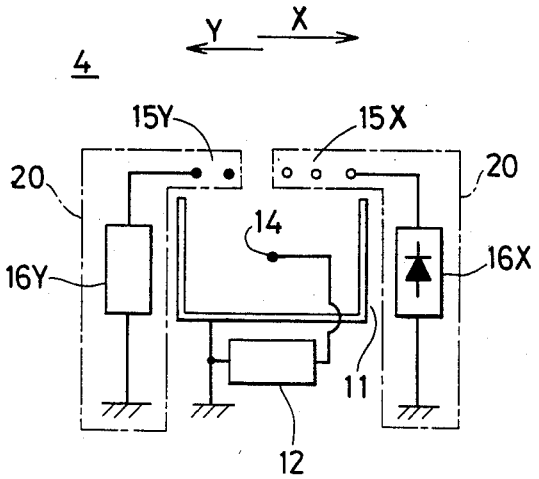

FIG. 6 shows another transferring means 4 which comprises a single wire electrode (corona electrode) 14 in a sealed case 11 and two regulation means 20X and 20Y. The regulation means 20X comprises a regulation grid 15X and a regulation device 16X. The regulation means 20Y comprises a regulation grid 15Y for discharge and a regulation device 16Y. Both grids 15X and 15Y are disposed at the opening of the case 11, so that the transfer region X and the discharge region Y are substantially adjacent to each other. The wire electrode 14 is connected to a high AC voltage source 12. The regulation grids 15X and 15Y can be controlled independently. The regulation grid 15X is connected to a regulation device 16X such as a diode or a DC power source such that corona ions from the wire electrode 14 having a different polarity from the charging polarity of the toner pass through the regulation grid 15X. In order to prevent electrical contamination of the latent image due to electric discharge between the transfer paper and the latent image, the regulation grid 15Y serves to reduce the amount of corona ions, which act on the back face of the transfer paper, and/or discharges a portion of the back face of the transfer paper in cooperation with a regulation device 16Y such as a resistor or a diode. The grid 15Y can be directly grounded without the regulation device 16Y. Since the transferring means 4 mentioned above comprises a small scale-sealed case 11 and a single corona charger, the production cost thereof can be remarkably lowered.

Figure 7:
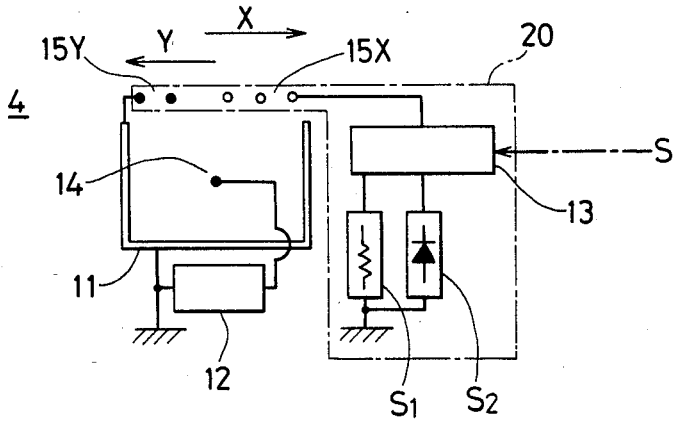

FIG. 7 shows another transferring means 4 comprising a single sealed case 11 and a regulation means 20 which contains regulation grids 15X and 15Y, a selection circuit 13 connecting to the grid 15X, the resistor $S_1$ and the diode $S_2$. The resistor $S_1$ and the diode $S_2$ are connected in parallel to the selection circuit 13. The regulation grid 15X is grounded through the resistor $S_1$ or the diode $S_2$ by operation of the selection circuit 13. The regulation grid 15Y must be grounded directly or through a resistor except when the final copy is produced.

The selection circuit 13 selects a grounding mode depending upon the external signal S relating to the quantity of copies to maintain strength of the transfer electric field at a certain level, thereby minimizing a decrease of the amount of toner to be transferred to the transfer paper resulting from the latent image which decays as a predetermined quantity of copies are successively produced.

The selection circuit 13 at the time when five copies are produced operates as follow:

When an external signal S relating to the quantity of copies is applied to the selection circuit 13, the circuit 13 selects the resistor $S_1$, first, to thereby connect the regulation grid 15X to the resistor $S_1$. Then, the apparatus begins the copying operation. After three copies are produced, the selection circuit 13 connects the regulation grid 15X to the diode $S_2$ instead of the resistor $S_1$ and the apparatus continues the copying operation to produce the fourth and the fifth copies.

Figure 8:
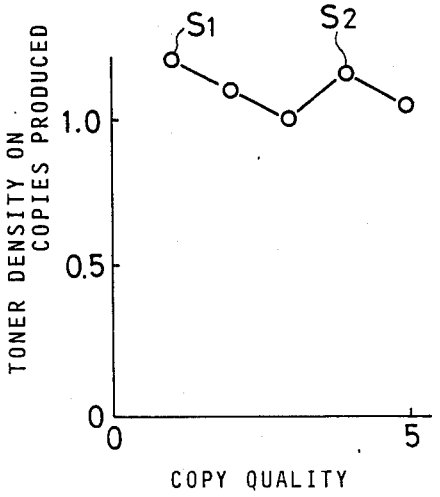
FIG. 8 is a graph showing the relationship between the quantity of copies and the image density on the transfer paper at the time when the apparatus of this invention containing the transferring means in FIG. 7 is employed
Figure 9:
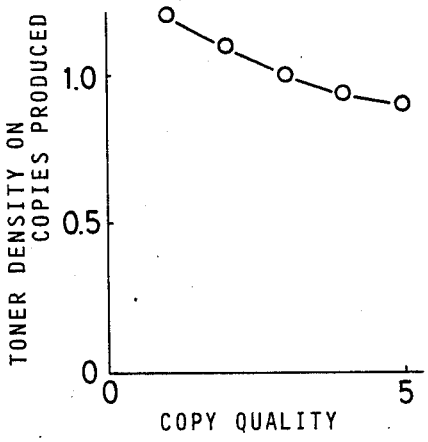
FIG. 9 is a graph showing the relationship between the quantity of copies and the image density on the transfer paper at the time when a conventional apparatus is employed.

When the diode $S_2$ is selected, corona ions having the same polarity as the toner in the transfer region X are leaked to the ground to thereby increase the transfer efficiency so that a decrease of the amount of toner to be transferred to the transfer paper can be suppressed. Thus, the toner density of the resulting fourth and the fifth copies is high enough as shown in FIG. 8, compared with that of the fourth and the fifth copies produced according to a conventional apparatus as shown in FIG. 9. The time when the diode $S_2$ instead of the resistor $S_1$ is connected to the regulation grid 15X by the selection circuit 13 depends upon the toner density of the copies to be produced. In the above-mentioned example, as soon as a predetermined quantity of copies is produced, the change from the resistor $S_1$ to the diode $S_2$ is automatically conducted. An alternative transferring means 4 can contain plural different resistors, one of which is successively selected by the selection circuit 13 to gradually increase the transfer efficiency. As the external signal S which must be applied to the selection circuit 13 to produce the necessary quantity of copies having a certain level of toner density, a signal for detecting the surface potential of the photoreceptor can be used.

Figure 10:
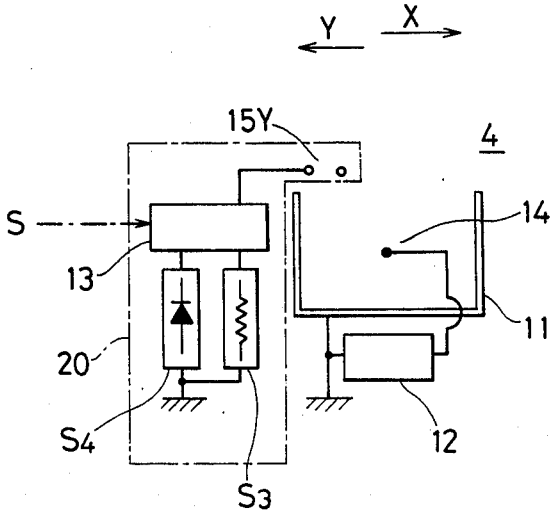
FIGS. 10 and 11 are other transferring means, respectively, of this invention.

FIG. 10 shows another transferring means 4 which comprises a regulation means 20 in the discharge region Y in order that every time two copies are produced, the reproduction of the electrostatic latent image is carried out. The resistor $S_3$ is connected to the regulation grid 15Y (or the regulation grid 15Y is directly grounded) in the transfer step for the first copy and the diode $S_4$ is selected in the succeeding transfer step for the second copy, so that an electrical contamination of the latent image on the photoreceptor can be effectively avoided.

Figure 11:
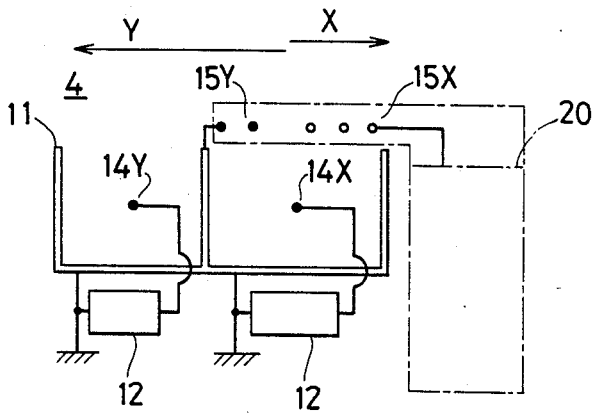

FIG. 11 shows another transferring means 4 comprising two chargers 14X and 14Y to enlarge the discharge region Y in which the regulation grid 15Y is always grounded directly or through a resistor except when the final copy is produced using the same latent image as the preceding copy. The other operation manner of the regulation means 20 is the same as the above-mentioned.

Any of the above-described transferring means 4 is designed to control a single block of the regulation grid, but it is not limited thereto. The grid can be divided into plural blocks, each of which must be controlled within the transferring means 4. A part of the discharge region Y can be used for the succeeding separation step. As the photoreceptor, a seamless drum, an endless belt, etc., can be employed.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. An electrophotographic recording apparatus which repeats the development of an electrostatic latent image corresponding to the original, which is formed once on an image supporting means, with a toner and the succeeding transfer of the resulting toner image to a transfer substance, thereby producing a number of copies of the original, wherein said recording apparatus comprises a transferring means having at least one corona charger and at least one regulation means, said corona charger being connected to a high AC voltage source to repeatedly conduct transfer and discharge, regions in which said transfer and said discharge are carried out, respectively, being adjacent to each other, said regulation means controlling the transfer efficiency of said transferring means depending upon an external signal with regard to at least one of the quantity of copies, and the decrease in the surface potential of the transfer substance.

2. An electrophotographic recording apparatus according to claim 1, wherein an AC corona generated in said transfer region contains an element having a different polarity from the charging polarity of said toner to a greater extent than the same polarity as that of said toner, and acts on the back face of said transfer substance.

3. An electrophotographic recording apparatus according to claim 1, wherein said transferring means has at least two corona chargers, said corona charges being disposed in the transfer region and the discharge region, respectively.

4. An electrophotographic recording apparatus according to claim 1, wherein said transferring means has at least two corona chargers, said corona chargers being disposed in the transfer region and the dischage region, respectively, and said regulation means is used for transfer and is disposed in the transfer region.

5. An electrophotographic recording apparatus according to claim 1, wherein said transferring means has at least two corona charges which are disposed in the transfer region and the discharge region, respectively, and at least two regulation means, one of which is used for transfer and the other of which is used for discharge, said regulation means being disposed in the transfer region.

6. An electrophotographic recording apparatus according to claim 1, wherein said transferring means has at least two regulation means, one of which is used for transfer and the other of which is used for discharge, said regulation means being controlled independently.

7. An electrophotographic recording apparatus according to claim 1, wherein for transfer of the toner image to the transfer substance, a high AC voltage having a different polarity from the charging polarity of the toner and being unsymmetrical with respect to zero voltage thereof is applied to said corona charger.

8. An electrophotographic recording apparatus according to claim 4, 5 or 6 wherein said regulation means comprises a regulation grid.

9. An electrophotographic recording apparatus according to claim 8, wherein said regulation means further comprises a selection circuit for selecting a grounding mode of said regulation grid to control the transfer efficiency of the transferring means.

10. An electrophotographic recording apparatus according to claim 9, wherein said regulation grid is grounded through a resistor or a diode selected by said selection circuit depending upon said external signal.

* * * * *